US006250403B1

(12) United States Patent
Beckwith

(10) Patent No.: US 6,250,403 B1
(45) **Date of Patent: *Jun. 26, 2001**

(54) DEVICE AND METHOD FOR ENLARGING A BORE

(75) Inventor: Jerry Wayne Beckwith, Perry, OK (US)

(73) Assignee: The Charles Machine Works, Inc., Perry, OK (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/940,385

(22) Filed: Sep. 30, 1997

(51) Int. Cl.[7] ..... E02F 5/10
(52) U.S. Cl. ..... 175/53; 175/62; 405/184
(58) Field of Search ..... 175/53, 401, 406, 175/628, 394, 397; 405/184; 37/189, 385, 386; 172/540

(56) References Cited

U.S. PATENT DOCUMENTS

| | | | | |
|---|---|---|---|---|
| 269,548 | | 12/1882 | Stephenson . | |
| 1,494,274 | | 5/1924 | Morgan | 175/263 |
| 1,582,283 | | 4/1928 | Lane | 175/283 |
| 1,667,155 | | 4/1928 | Higdon | 175/263 |
| 1,937,742 | | 12/1933 | Brink . | |
| 1,987,291 | * | 1/1935 | Gliwitzki | 175/406 X |
| 2,365,941 | * | 12/1944 | Crake | 175/394 X |
| 2,830,795 | * | 4/1958 | Center, Jr. | 175/394 X |
| 3,162,257 | | 12/1964 | Noyes | 175/403 |
| 3,710,523 | * | 1/1973 | Taylor | 52/157 |
| 3,898,895 | | 8/1975 | Taylor | 76/102 |

FOREIGN PATENT DOCUMENTS

| | | | |
|---|---|---|---|
| 2587630 | * | 3/1987 | (FR) . |
| 247473 | | 2/1926 | (GB) . |
| 26951 | * | 4/1932 | (NL) . |

OTHER PUBLICATIONS

Ditch Witch 4/40A (Jet Trac® Boring System), Issue No. 5/PL–8/96, 1993, pp. 801–171.

*Primary Examiner*—Eileen D. Lillis
*Assistant Examiner*—Sunil Singh
(74) *Attorney, Agent, or Firm*—McKinney & Stringer, P.C.

(57) ABSTRACT

A device and method for enlarging a bore and installing a utility line. The device comprises an elongate shaft having a first and second end. The first end of the shaft is connectable to the drill string of a horizontal boring machine. The second end is connectable to a utility line or other device to be installed in the bore. The device is pulled through a pilot bore and enlarges the bore to a desired diameter while simultaneously pulling in a utility line. A set of cutting elements supported near the first end of the shaft, with 120 degree spacing therebetween, enlarges the bore to an intermediate diameter. A series of blades are supported on the shaft between the cutting elements and the second end. The first blade further enlarges the hole behind the cutting elements to the final desired diameter. Along its outer edge, the first blade comprises a plurality of teeth adapted to slice through the wall of the bore. Following the first blade are a second and a third blade, each of which churn the spoils created by the first blade. A central passageway through the shaft transmits drilling fluid to fluid jets positioned near the blades and the cutting elements. The fluid jets clean the blades during the reaming operation and inject fluid into the formation to mix slurry and lubricate the equipment. The device is lighter than conventional backreamers due to its unique design and configuration, yet dramatically increases the penetration and productivity rates over conventional backreamers.

45 Claims, 4 Drawing Sheets

U.S. PATENT DOCUMENTS

| | | | | |
|---|---|---|---|---|
| 3,923,652 | | 12/1975 | Condolios et al. | 210/67 |
| 3,967,689 | | 7/1976 | Cherrington | 175/391 |
| 4,121,668 | * | 10/1978 | Miner | 172/42 |
| 4,248,314 | | 2/1981 | Cunningham et al. | 175/344 |
| 4,266,830 | | 5/1981 | Retka et al. | 198/778 |
| 4,467,575 | | 8/1984 | Dziedzic | 52/157 |
| 4,727,943 | | 3/1988 | Wood | 175/229 |
| 4,728,275 | | 3/1988 | DiLullo et al. | 425/67 |
| 4,915,182 | * | 4/1990 | Magyari et al. | 175/403 |
| 4,923,165 | | 5/1990 | Cockman | 248/545 |
| 4,924,953 | | 5/1990 | Moser | 175/323 |
| 4,981,000 | | 1/1991 | Hamilton et al. | 52/157 |
| 5,011,107 | | 4/1991 | Reece | 248/545 |
| 5,027,914 | | 7/1991 | Wilson | 175/406 |
| 5,160,609 | | 11/1992 | Vander Der Herberg | 210/143 |
| 5,174,374 | | 12/1992 | Hailey | 166/55.6 |
| 5,303,787 | * | 4/1994 | Brady | 175/430 |
| 5,351,764 | * | 10/1994 | Cherrington | 175/53 |
| 5,368,114 | | 11/1994 | Tandberg et al. | 175/267 |
| 5,368,415 | | 11/1994 | Kono et al. | 405/267 |
| 5,390,750 | | 2/1995 | Deken et al. | 175/406 |
| 5,408,788 | | 4/1995 | Hamilton et al. | 52/157 |
| 5,456,552 | | 10/1995 | Cherrington | 405/184 |
| 5,641,027 | * | 6/1997 | Foster | 175/107 |
| 5,687,807 | | 11/1997 | Woods et al. | 175/393 |
| 5,794,727 | | 8/1998 | Murray | 175/394 |
| 5,833,015 | | 11/1998 | Hesse et al. | 175/40 |

* cited by examiner

DEVICE AND METHOD FOR ENLARGING A BORE

FIELD OF THE INVENTION

The present invention relates generally to devices for enlarging bores and particularly to backreaming devices used in the horizontal boring industry. The present invention further relates to methods of enlarging a borehole and installing and constructing utility lines, pipe lines and the like.

SUMMARY OF THE INVENTION

The present invention is directed to a device for making or enlarging a bore. The device comprises an elongate body connectable to a source for moving the device through the bore and a plurality of blades, each blade defining a plane. The blades are supported on the body so that the planes of the blades intersect.

The present invention further is directed to a method for enlarging a bore using a boring machine adapted to bore a pilot bore in the earth from a point of entry to an exit point distant from the boring machine. The method comprises the steps of connecting an enlarging device to the distal end of the boring machine, the enlarging device comprising an elongate body connectable to a source for moving the device through the bore and a plurality of blades, each blade defining a plane, wherein the blades are supported on the body so that the planes of the blades intersect, and moving the enlarging device through the bore in a manner to enlarge the bore.

Finally the present invention is directed to a method for installing utility lines and the like by using a boring machine adapted to bore a pilot bore in the earth from a point of entry to an exit point distant from the boring machine. The method comprises the steps of connecting an enlarging device to the distal end of the boring machine, the enlarging device comprising an elongate body connectable to a source for moving the device through the bore and a plurality of blades, each blade defining a plane, wherein the blades are supported on the body so that the planes of the blades intersect, moving the enlarging device through the bore in a manner to enlarge the bore, and simultaneously pulling in the utility line into the bore while moving the enlarging device through the bore.

BRIEF DESCRIPTION OF THE DRAWINGS

FIG. 9 is a side elevational view of a boring machine utilizing a device in accordance with the present invention.

DETAILED DESCRIPTION OF THE PREFERRED EMBODIMENTS

Figure 1:
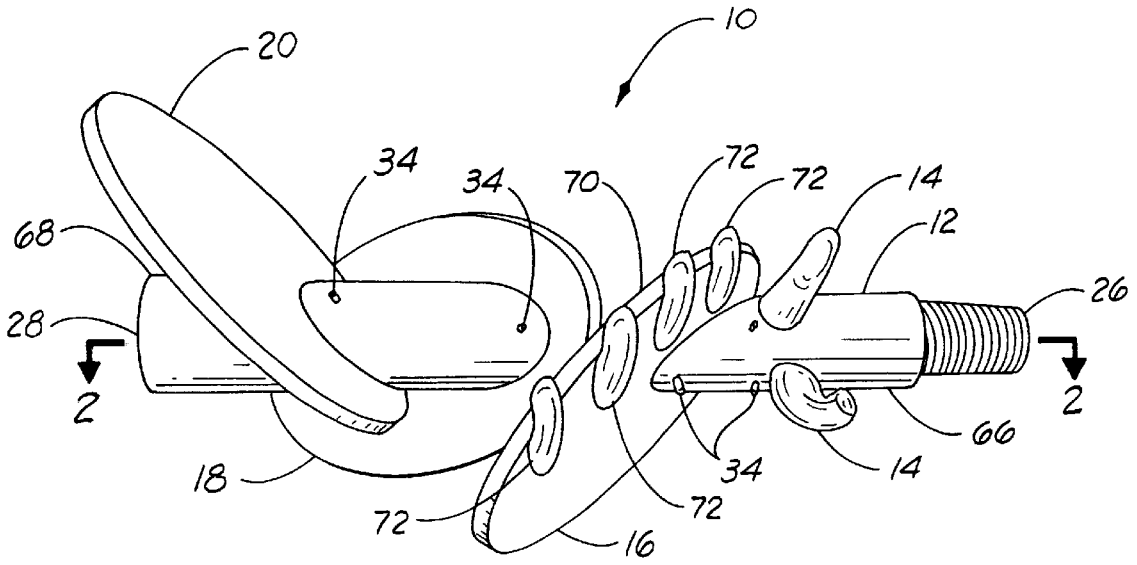
FIG. 1 is a perspective view of the device of the present invention.

Over the last decade, trenchless technology has been overtaking the market for the construction of underground utilities. Trenchless technology, or the technology of boring underground without digging a trench, eliminates the need to excavate earth in order to lay a utility line, pipeline or other underground construction works. As such, the overburden remains undisturbed and need not be rehabilitated following completion of the job.

In the typical underground utility installation employing trenchless technology, a pilot bore is made underground along a planned path using a horizontal boring system. A variety of boring systems are available for making the pilot bore and one will be selected depending upon the conditions in which the installation is to take place, such as whether the soil is rocky or sandy, the length and diameter of the installation, the power needed to complete the installation and, the type of steering equipment and electronics required to determine the orientation and placement of the drill bit underground. For example, if a telephone line is to be laid underneath a river, a boring machine having the necessary power and equipment is placed on one side of the river at the earth entry point. The boring machine generally comprises a drill string made of a series of connected pipe joints. A drill bit is attached to the end of the drill string. The size of the bit selected depends upon the size of the pilot bore to be made, which in turn depends upon the size and type of utility or other line to be installed. The machine is operated to force the bit into the ground to drill the pilot bore in a generally arcuate path underneath the river. Additional lengths of pipe are added as needed to reach the exit point on the opposite shore of the river distant from the boring machine. The drill bit exits the earth at the exit point.

At this point in the installation process, the pilot bore is complete. A long, connected string of pipe lies in an arcuate path in the pilot bore underneath the river with the drill bit protruding at the exit point distant from the boring machine. The pilot bore then may be enlarged by replacing the drill bit with an enlarging device, commonly known as a backreamer. The backreamer is connected to the distal end of the drill string and moved through the pilot bore toward the boring machine, either with or without rotation of the drill string. The backreamer may be adapted to pull in a utility line or the like behind it as the string of drill pipe is moved in the reverse direction through the arcuate path back toward the boring machine. The backreamer expands the bore to the desired diameter and stabilizes the walls of the bore to create an environment in which a utility line can be pulled in behind the backreamer into place in the bore.

Various backreamers are commercially available. Some conventional backreamers are conical in shape and are particularly suited for compressing compactible soils into the wall of the bore. These backreamers frequently are pulled without rotation through the pilot bore to compact the loose soil. Alternatively, other conventional cone-shaped backreamers comprise helical screw-style threads and are rotated while pulled through the pilot bore to enlarge the bore to the desired diameter.

Frequently, fluid is injected into the formation to create a slurry with the spoils, i.e. the cuttings, rocks, dirt and soil, produced during the reaming process. When fluid is used in association with conventional cone-shaped backreamers, the cones function like hydraulic cylinders. The fluid flow and pressure must be reduced or shut off periodically to decrease the hydraulic pressure build up in the bore, causing time delays and expense.

Further, in order to accomplish the objective of enlarging the pilot bore and stabilizing the walls, conventional backreamers are composed of a heavy metal alloy composition. These devices must be used with a machine capable of exerting significant pull back forces and, when rotating the drill string, greater torquing forces.

The device of the present invention is uniquely constructed and designed to reduce the torque and power required to cut soil material loose during the reaming process, and thus increase the productivity over conventional backreamers, but the device weighs approximately fifty percent less than conventional backreamers. Consequently, smaller boring machines capable of less torque and pullback forces are able to enlarge pilot bores to larger diameters using the device of the present invention. In some cases, small boring units using the present invention may enlarge bores during the reaming process up to at least 1.5 times larger than is possible using a conventional backreamer.

The device of the present invention comprises a series of blades supported on a body so that the planes formed by the blades intersect. As the backreamer is pulled and rotated through the pilot bore, the blades cut the soil, enlarge the bore, disperse the cuttings, thoroughly mix the drilling fluid/soil slurry and stabilize the wall of the bore. The first blade cuts and increases the bore to the desired diameter. The following blades churn the soils to break up and disperse chunky cuttings, thus preventing the cuttings from sticking to the reamer, the utility line or the drill string in the bore. The following blades disperse sticky cuttings to prevent the downhole equipment from sticking in the bore and to minimize the torque required to free the equipment. The hind blades of the device of the present invention are particularly adapted to churn the spoils and break up large chunks of cuttings to make a smooth, even slurry, thus improving flowability of the slurry for better lubrication for the utility line and the drill string and a dramatic increase in the rate of penetration of the backreamer. The subject backreamer is particularly productive in clays, sandy soils and semi-hard materials. These and other advantages of the present invention will be apparent from the following description of the preferred embodiments.

Figure 2:
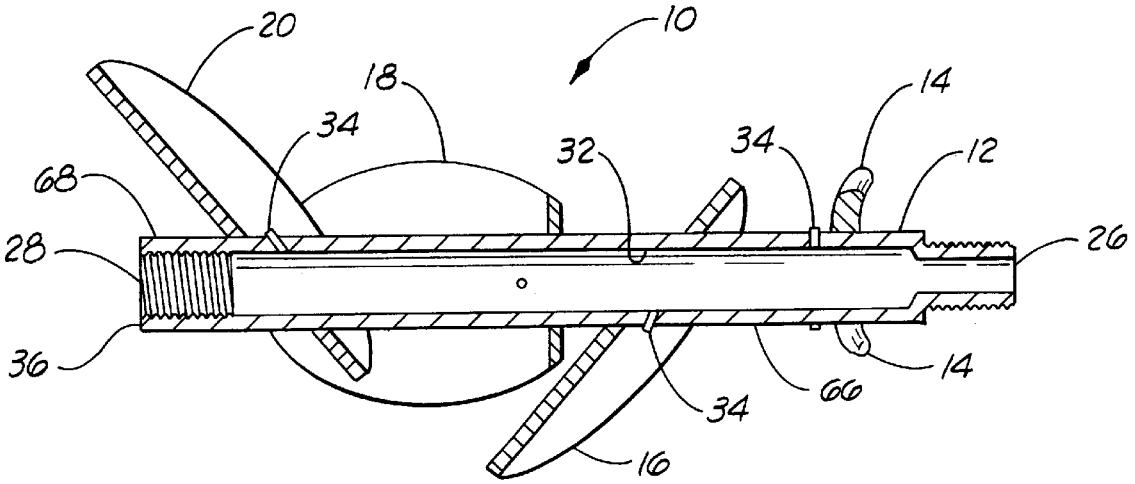
FIG. 2 is a cross-sectional view of the device taken along line 2—2 of FIG. 1.

Turning now to the drawings in general and to FIGS. 1 and 2, in particular, there is shown therein a device 10 for enlarging boreholes and constructed in accordance with the present invention. The device 10 generally comprises a body 12, cutting elements 14, a first blade 16, a second blade 18 and a third blade 20.

The body 12 preferably is elongate and forms a structure or surface adapted to support the cutting elements 14 and the blades 16, 18 and 20. Generally, a cylinder or other elongate, structure is sufficient to meet this need. However, any body shape, structure or length able to support the elements of the invention in the desired order will suffice. The body preferably is hollow for a purpose yet to be described.

Figure 3:
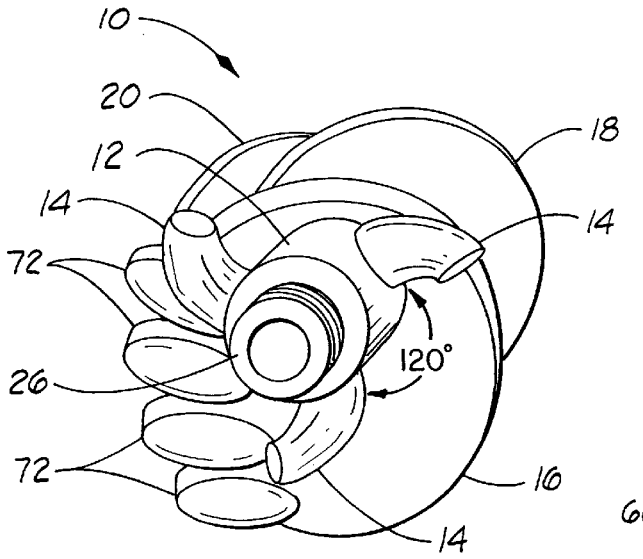
FIG. 3 is an elevational view of the device of FIG. 1 as seen from the first end.

Ordinarily, in the horizontal boring process, successive lengths of drill pipe are added to the drill pipe sections as the boring process progresses and the bit drills farther along the planned path to the exit point. At the exit point, the drill bit will be removed exposing a pipe joint to which the device 10 is attachable. To that end, the body 12 forms a first end 26 and second end 28, the first end 26 being operatively connectable to a string of drill pipe (not shown). In one preferred embodiment, the first end 26 is externally threadable, as shown in FIG. 3, to the exposed, internally threaded pipe joint at the end of the drill string. It will be appreciated, however, that the first end 26 of the body 12 may be internally threaded or may be connectable to the drill string by any means sufficient to securely and operatively engage the device 10 with the drill string.

Figure 4:
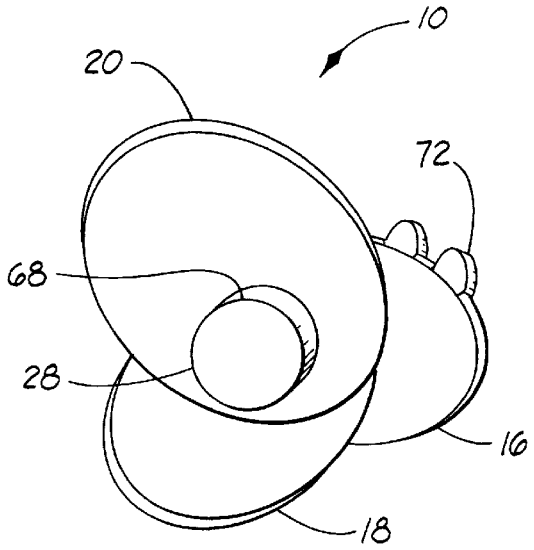
FIG. 4 is an elevational view of the device of FIG. 1 as seen from the second end.

The second end 28 of the body 12 may be plugged, as shown in FIG. 4. Alternatively, a swivel or other device may be attached to the second end 28 of the body 12 to enable a utility line to be pulled in behind the device 10 in a manner yet to be described.

With continuing reference to FIG. 1, the body 12 preferably is comprised of a sturdy, high tensile strength material, preferably a steel alloy. Although various materials may be used to build the body 12, a high-strength, low-alloy steel generally provides the necessary strength and durability to resist wear and abrasion and increase the life of the device 10. The device 10 thus maintains the strength and cutting power of steel; however, as explained herein, the unique design of the device decreases the weight of the device over conventional backreamers by about fifty percent while dramatically increasing productivity, efficiency and cutting power.

The length and diameter of the body 12 of the device 10 depends upon the desired sized of the borehole, the horsepower and pullback capabilities of the boring unit, and the soil conditions at the site, among other factors. When reaming large diameter bores, the body 12 must be of sufficient size and strength to support larger, heavier blades 16, 18 and 20 and cutting elements 14. Typically, the body 12 length ranges from about fifteen inches to about seventy inches, and the diameter of the body 12 ranges from about 2 inches to about 4¼ inches.

Turning now to FIG. 2, the body 12 preferably forms a passageway 32 to channel fluid under pressure from the drill string through fluid jets 34 and forms a wall 36 having a thickness ranging generally from about ½ to about ¾ inches thick. It will now be appreciated that the body 12 is hollow to permit the passage of fluid through the device 10 into the borehole. Fluid jets 34 are positioned near the cutting elements 14 and the blades 16, 18 and 20 in a manner yet to be described. In the preferred practice of the invention, at least three fluid jets 34 are positioned near blades 16, 18 and 20 and one fluid jet near each cutting element 14. The fluid from fluid jets 34 are sized and positioned to clean the blades 16, 18 and 20 and cutting elements 14 to create an adequate slurry in a manner and for purposes yet to be described.

With continuing reference to FIGS. 1 and 2, the device 10 preferably comprises a plurality of cutting elements 14. The cutting elements 14 are sized and positioned to make first contact with the walls of the pilot bore as the device 10 is moved through the pilot bore toward the boring machine and increases the diameter of the bore. For this purpose, the cutting elements 14 preferably are spaced circumferentially in one plane about the body 12 near the first end 26 of the device 10. In one preferred embodiment, illustrated in FIG. 3, three cutting elements 14 are supported circumferentially about the body 12 in one plane perpendicular to the axis of the body 12 and uniformly spaced about the body approximately 120° apart. The uniform spacing stabilizes the device 10 in the borehole and evenly distributes the cutting force of the cutting elements 14. It will be appreciated that the number and size of the cutting elements 14 may be increased or decreased to achieve a desired cutting pattern and efficiency and that the cutting elements may be positioned at other locations on the device 10 or in different planes of reference.

The cutting elements 14 are of sturdy composition, preferably high gauge steel, and are supported on the device 10 by any means sufficient to secure the cutting elements to the body 12. Welding has proven an effective means of permanently attaching the cutting elements 14 to the body 12. The cutting elements 14 may be removably attached to the body 12 to permit repair and replacement as needed. For this purpose, the cutting elements 14 and the body 12 may be adapted to receive a bolt and nut assembly or other device adapted to removably secure the cutting elements to the body.

With continuing reference to FIGS. 1, 2 and 3, the cutting elements 14 may be any shape, surface, configuration or structure adapted to contact the walls of the pilot bore and enlarge the bore to a selected intermediate or final diameter. In one preferred embodiment, claw-like structures provide a useful first cutting element 14. As the device 10 is rotated clockwise, the cutting elements 14 gouge the walls of the bore and increase the bore diameter. A knife-edged, toothed or cylindrical surface or structure provide a few suitable alternatives. It will be appreciated that any device, surface, shape, configuration or structure which enlarges the bore will serve as a suitable cutting element 14.

The size of the cutting elements 14 depends at least in part upon the desired final diameter of the borehole. In one preferred embodiment, the cutting elements 14 enlarge the bore to an intermediate diameter and, thereafter, the blade 16 enlarges the bore to the final diameter in a manner yet to be described. However, it will be appreciated that the cutting elements 14 may be sized to enlarge the bore to the final diameter or to any diameter in between the pilot bore diameter and the selected final bore size.

Figure 5:
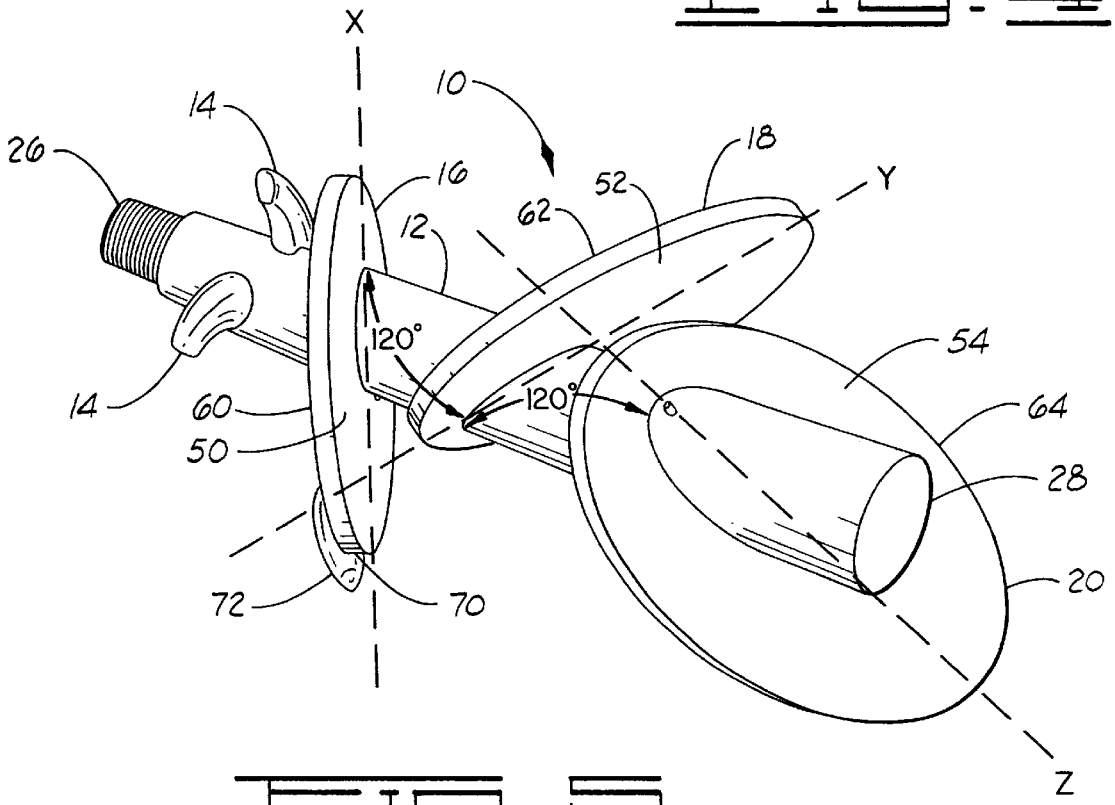
FIG. 5 is a perspective view of the device of the present invention showing the positioning of the blades with respect to the body of the device.

Turning now to FIG. 5, the device 10 preferably further comprises a plurality of blades supported on the body 12. In one preferred embodiment, the plurality comprises three blades 16, 18 and 20; however, the number of blades may be increased or decreased depending upon various conditions, such as the type of soil at the construction site, the desired characteristics of the slurry and other factors. Each blade 16, 18 and 20 forms a plane x, y and z, respectively, and is positioned on the body 12 so that the planes of the blades intersect. While the blades 16, 18 and 20 may be mounted on the body 12 at any angle which causes the planes x, y and z to intersect, the mounting angle generally ranges from about 20° to about 70° with respect to the body 12. In one preferred embodiment, the blades 16, 18 and 20 are mounted on the body 12 so that the respective planes x, y and z form an angle of about 45° with respect to the body. It is not required that each blade intersect each plane of the other blades, but that the plane of each blade intersect with the plane formed by at least one the other blades.

Figure 6:
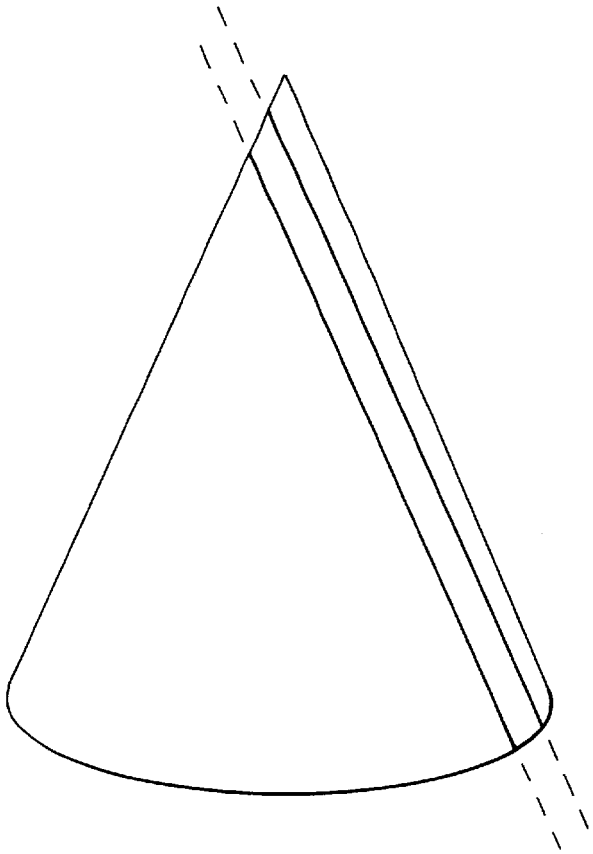
FIG. 6 is a perspective view of a cone illustrating the origin of one preferred blade configuration.

The shape of the blades 16, 18 and 20 may vary. In one preferred embodiment, the blades 16, 18 and 20 are generally ovate and derive their shape from the bisection of a cone, as illustrated in FIG. 6. As shown therein, a conventional cone-shaped backreamer is sliced along two parallel lines, and the resulting bisection, which is generally ovate, provides the desired shape for the blades 16, 18 and 20 and produces surfaces 50, 52 and 54 which meet with edges 60, 62 and 64. The blades 16, 18 and 20 range generally from about ½ inch to about 1¼ inches in thickness and have a radius from about 6 inches to about 36 inches. Alternatively, other shapes, such as triangular, square, circular and hexagonal, provide suitable alternative blade shapes. It will be appreciated that any shape which enables the blades to slice through soil and churn spoils provides a suitable blade shape for the device 10.

Returning to FIGS. 3, 4 and 5, the blades 16, 18 and 20 may be mounted to the body 12 so that the blades physically connect with each other or the blades may be separated, preferably with about at least six inches between mountings. The blades 16, 18 and 20 preferably are mounted to the body 12 through the surfaces 50, 52 and 54, respectively of the blades so that the blades transect the body. Alternatively, the blades 16, 18 and 20 may be mounted on the body at the edges 60, 62 and 64, respectively of the blades.

Welding is a preferred means for mounting the blades 16, 18 and 20 to the body 12. However, it will be appreciated that the blades 16, 18 and 20 may be mounted by any means sufficient to permanently or removably mount the blades to the body 12 and permit operation of the device 10. For example, the blades 16, 18 and 20 may be adapted to removably mount the blades to enable repair and replacement of the blades without replacing the entire device.

With continuing reference to FIGS. 1 through 5, the blades 16, 18 and 20 preferably are mounted on the body 12 in a clockwise direction from the front side 66 to the back side 68 of the body 12 and from the first end 26 of the body to the second end 28 about 120 degrees apart. This spacing and positioning stabilizes the device 10 in the bore. It will be appreciated that this spacing and positioning of the blades may be varied to achieve a desired effect. For instance, the blades 16, 18 and 20 may be placed on the front side 40 of the device 10 or two blades may be supported on one side. However, a uniform spacing and positioning of the blades stabilizes the device 10 in the borehole and produces a more uniform bore.

In the preferred practice of the invention, blade 16 is mounted on the body 12 between the second end 28 and the cutting elements 14, while blades 18 and 20 are mounted between the first blade and the second end 28 of the body. During operation of the device 10, blade 16 proceeds through the bore before blades 18 and 20 and enlarges the bore to the final diameter. To that end, blade 16 preferably comprises an outer, arcuate leading edge 70 adapted to slice through soil, rock and other material from the wall of the bore to increase the diameter of the bore. The leading edge 70 may comprise a plurality of cutting teeth 72 or other sharp edge or cutting device adapted to cut material from and enlarge the bore. The angle at which blade 16 is mounted to the body 12, coupled with the unique blade configuration and the leading edge 70, enables blade 16 to slice through the soil and enlarge the bore to the final diameter. It will now be appreciated that the angular orientation of the blade 16 enables the leading edge 70 to slice through the bore wall and direct cuttings toward the second end 28 of the device 10. The cutting teeth 72 or other cutting device may be permanently mounted to blade 16 by welding or other means or adapted to be removed for repair and replacement.

Figure 7:
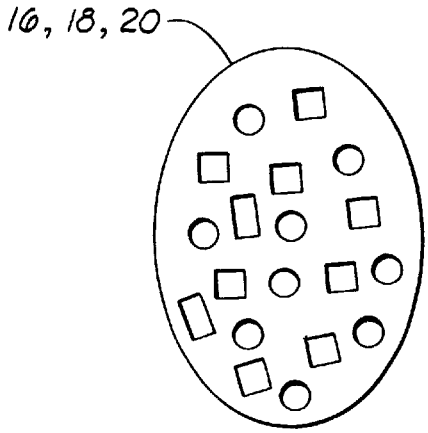
FIG. 7 is a plan view of one embodiment of the blades of the device of the present invention showing perforations in the blades.
Figure 8:
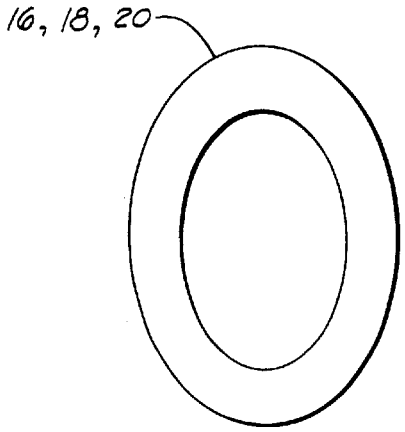
FIG. 8 is a plan view of another embodiment of the blades of the device of the present invention showing a ring-shaped blade.
Figure 5:
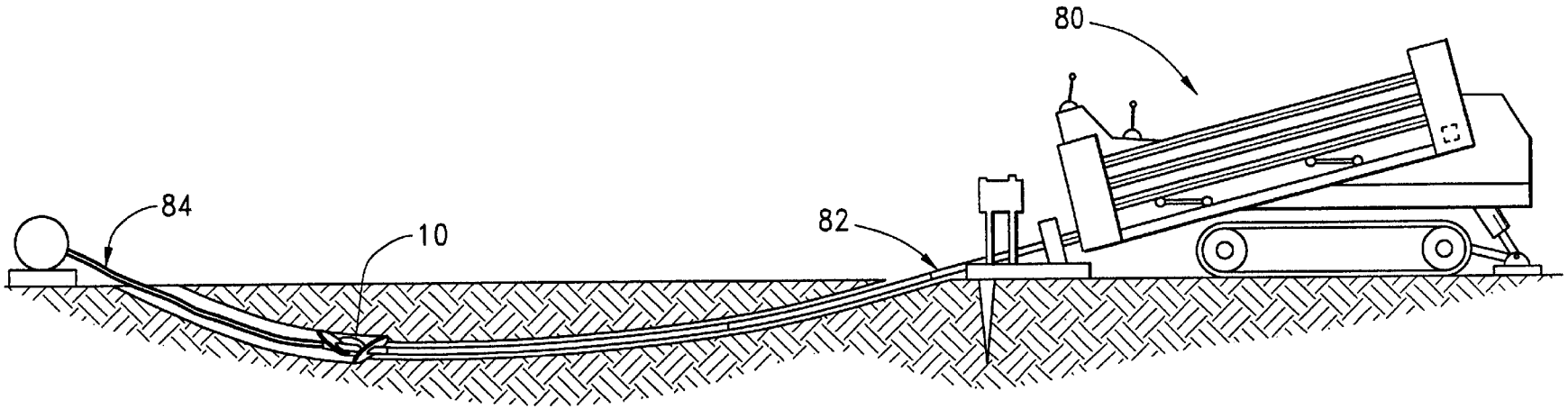

Blades 18 and 20 are mounted between the blade 16 and the second end 28 of the body 12. Blades 18 and 20 maintain the position of the device 10 in the borehole and churn the spoils created by blade 16. Blades 18 and 20 may form solid plates or may be perforated or dimpled to enhance the churning capabilities and thereby increase productivity. Perforated blades, shown in FIG. 7, and "O-ring" shaped blades, shown in FIG. 8, are some acceptable alternative embodiments of blades 16, 18 and 20. The churning capabilities of blades 18 and 20 have proven particularly useful in sticky soils and clays. Blades 18 and 20 actively mix spoils so that the spoils are suspended in the fluid from the jets, eliminate large chunks of soil, and mix a slurry with improved fluidity, solids suspension and lubrication characteristics.

Referring again to FIGS. 1 and 2, it now will be appreciated that the blades 18 and 20 mix a slurry with the spoils created by blade 16 and the fluid injected into the bore by fluid jets 34. To accomplish that purpose, fluid jets 34 are positioned on the body 12 of the device 10 adjacent the cutting elements 14 and each blade 16, 18 and 20. In the preferred embodiment, thirteen fluid jets 34 are supported on the body 12. Three fluid jets 34 are positioned in front of the cutting elements 14. Four fluid jets 34 are positioned near blade 16, one of which is in front of the leading edge 70 to force spoils over the blade 16 toward the second end 28 of the device 10. Three fluid jets 34 are positioned near each blade 18 and 20. Preferably, the fluid jets near the blades 16, 18 and 20 are angled transversely with respect to the surface of the body 12 and are directed at the blades to clean the blades during the reaming operation. The fluid from fluid jets 34 deflects off of the blades 16, 18 and 20 and mixes with the spoils to create a slurry and lubricate the equipment in the bore.

Turning now to FIG. 9, there is shown therein a horizontal boring machine 80 in accordance with the present invention. The boring machine 80 operates a drill string 82 made of a series of connected pipes. A drill bit is attached to the front end of the drill string 82 to dig the pilot bore. After the pilot bore has been dug, the drill bit is exposed at the remote end of the borehole and the drill bit is replaced with the back-reaming device 10. A utility line 84 is attached to the device 10 through a swivel. The drill string is pulled back through the borehole, so that the bore is backreamed by the back-reaming device 10. At the same time the utility line 84 is laid in the borehole.

The machine 80 illustrated is only an example of one of many types of boring and drilling machines available. The present invention is not limited to any particular type or model of machine.

The present invention also comprises a method for enlarging a bore. In accordance with the method of the present invention, a boring site is selected and a suitable boring machine assembled. The length and diameter of the borehole as well as the conditions of the terrain are considered in selecting the size and type of boring head, the length and diameter of pipe joints and the size of the machine.

Having the selected the site and assembled a suitable machine, the boring operation is commenced in a known manner. As the borehole increases in length, additional pipe joints are added. Boring proceeds along a predetermined path until the boring head emerges from the earth at an exit point. At this point, the device 10 may be connected to the last pipe in the drill string. The boring machine is then operated and the drill string rotated and removed while pulling the device 10 through the bore to ream the bore to the desired diameter. As the device 10 is rotated, fluid is circulated through the drill pipe and out of the fluid jets 34 of the device 10 to lubricate, create a slurry, compact the walls of the borehole, increase the fluidity of the slurry and keep the blades clean of spoils. As the device 10 is moved through the pilot bore and rotated, the cutting elements 14 make first contact with the walls of the pilot bore and initially ream the bore to a predetermined intermediate diameter. After the bore has been enlarged by the cutting elements 14, blade 16 enlarges the bore to the final desired diameter. It will now be appreciated that the leading edge 70 of blade 16 enlarges the bore and blades 18 and 20 stabilize the device 10 in the borehole and churn the spoils making a slurry. The slurry forms a filter cake on the wall of the bore to help prevent collapse of the wall on the equipment.

The present invention further is directed to a method for installing and constructing utility lines, pipe lines, cables and the like. The method of enlarging a borehole, described above, is employed, and a swivel is attached to the second end 28 of the body 12. The utility line is connected to the swivel. As the device 10 is moved through the bore behind the drill string, the utility line is pulled in behind the device 10 into place in the borehole.

Now it will be appreciated that the present invention provides an improved device for enlarging a bore. The device 10 of the present invention maintains the strength and cutting ability of conventional backreamers; however, the unique design and construction of the device decreases the weight of the device over conventional backreamers by about fifty percent while increasing productivity, efficiency and cutting ability. The cutting elements 14 of the device 10 make initial contact with the bore, while blade 16 enlarges the bore to the final diameter. Blades 18 and 20 churn the spoils stabilize the device 10 within the bore. The unique construction and configuration of the device and its elements results in a backreamer more than by fifty percent lighter in weight than conventional backreamers. Yet, productivity is significantly increased as the penetration rate can jump from ten feet in five to seven minutes using a conventional backreamer to about ten feet in one minute using the device of the present invention. The device 10 eliminates large chunks of cuttings, mixes the fluid with spoils to make a slurry with improved fluidity, improves suspension of cuttings in the slurry, lubricates the device and the utility pulled in behind the device, and a dramatically increases penetration rate. This device has proven particularly productive in clay soils and other soils which tend to clump and hinder the reaming process.

Changes may be made in the combination and arrangements of the various parts, elements, steps and procedures described herein, without departing from the spirit and scope of the invention as defined in the following claims.

I claim:

1. A device for making or enlarging a bore, the device comprising:

an elongate body connectable to a source for moving the device through the bore;

a plurality of planar blades;

wherein the blades are supported on the body so that the plane of each blade intersects the plane of at least one other of the blades and wherein each blade is supported on the body so that the plane of each blade transects the body.

2. The device of claim 1 wherein the body defines a first end and a second end and wherein the blades are circumferentially supported on the body in a clockwise direction from the first end to the second end and are spaced about 120° apart about the circumference of the body.

3. The device of claim 1 wherein the blades are supported on the body at an angle of about 20° to about 70° with respect to the body.

4. The device of claim 1 wherein the body defines a passage adapted to transmit fluid through the body.

5. The device of claim 1 wherein the body comprises a shaft having a first end and a second end and wherein the first end is threadably connectable to the source for driving the movement of the device.

6. The device of claim 5 wherein the second end comprises a plug.

7. The device of claim 5 wherein the second end is adapted to be connected to a utility line whereby the utility line can be pulled into the bore behind the device.

8. The device of claim 1 wherein each blade is generally ovate.

9. The device of claim 1 wherein:

the body forms a first end and a second end;

the plurality of blades comprises a first blade supported near the first end of the body; and the first blade is characterized by the ability to enlarge the bore.

10. The device of claim 9 wherein the first blade further comprises an edge adapted to cut the wall of the bore.

11. The device of claim 10 wherein the edge further comprises a plurality of cutting teeth adapted to cut the wall of the bore.

12. The device of claim 11 wherein the blades are comprised of steel.

13. The device of claim 9 wherein the plurality of blades further comprise a second blade and a third blade supported on the body between the first blade and the second end of the body, the second and third blades being characterized by the ability to chum spoils.

14. The device of claim 9 wherein the first blade is sized to enlarge the bore to a final diameter.

15. The device of claim 1 wherein at least one of the blades is perforated.

16. The device of claim 1 wherein at least one of the blades is ring-shaped.

17. The device of claim 1 wherein the body defines a first end and a second end and further comprises at least one cutting element supported on the body near the first end and adapted to make first contact with the walls of the bore and enlarge the bore as the device is moved through the bore.

18. The device of claim 17 wherein the at least one cutting element is claw-shaped.

19. The device of claim 17 wherein the at least one cutting element comprises a plurality of cutting elements spaced around the circumference of the body about 120° apart.

20. The device of claim 19 wherein the plurality of cutting elements are supported on the body in the same plane.

21. The device of claim 20 wherein the cutting elements are sized to enlarge the bore to an intermediate diameter.

22. The device of claim 1 wherein the device further comprises at least one fluid jet.

23. The device of claim 22 further comprising a plurality of fluid jets, wherein at least one of the fluid jets is adapted to direct fluid at the blades.

24. The device of claim 1 wherein the blades are from about ½ inch thick to about 1¼ inches thick.

25. The device of claim 1 wherein the blades have a radius from about 6 inches to about 36 inches.

26. The device of claim 1 wherein the body has a length from about 15 inches to about 70 inches.

27. The device of claim 1 wherein the body is comprised of steel.

28. The device of claim 1 wherein the blades are comprised of steel.

29. A method for enlarging a bore using a boring machine adapted to bore a pilot bore in the earth from a point of entry to an exit point distant from the boring machine, the method comprising the steps:

connecting an enlarging device to the distal end of the boring machine, the enlarging device comprising an elongate body connectable to a source for moving the device through the bore and a plurality of planar blades, wherein the blades are supported on the body so that the plane of each blade intersects the plane of at least one other of the blades and wherein each blade is supported on the body so that the plane of each blade transects the body; and moving the enlarging device through the bore in a manner to enlarge the bore.

30. The method of claim 29 wherein the step of moving the enlarging device through the bore further comprises the step of rotating the enlarging device while simultaneously pulling the enlarging device through the bore toward the boring machine.

31. The method of claim 29 further comprising the step of mixing a slurry while moving the device through the bore.

32. The method of claim 29 further comprising the step of directing fluid through the device toward each blade to clean each blade while moving the device through the bore.

33. The method of claim 29 wherein the step of enlarging the bore further comprises the steps of enlarging the bore first to an intermediate diameter and then to a final diameter.

34. A method for installing utility lines by using a boring machine adapted to bore a pilot bore in the earth from a point of entry to an exit point distant from the boring machine, the method comprising the steps of:

connecting an enlarging device to the distal end of the boring machine, the enlarging device comprising an elongate body connectable to a source for moving the device through the bore and a plurality of planar blades, wherein the blades are supported on the body so that the plane of each blade intersects the plane of at least one other of the blades and so that the planes of the blades transect the body;

moving the enlarging device through the bore in a manner to enlarge the bore; and simultaneously pulling in the utility line into the bore while moving the enlarging device through the bore.

35. The method of claim 34 wherein the step of moving the enlarging device through the bore further comprises the step of rotating the enlarging device while simultaneously pulling the enlarging device through the bore toward the boring machine.

36. The method of claim 34 further comprising the simultaneous step of mixing a slurry while moving the device through the bore.

37. The method of claim 34 further comprising the step of directing fluid through the device toward each blade to clean each blade while moving the device through the bore.

38. The method of claim 34 wherein the step of enlarging the bore further comprises the steps of enlarging the bore first to an intermediate diameter and then to a final diameter.

39. A device for making or enlarging a borehole, the device comprising:

an elongate body connectable to a source for moving the device through the bore, the body having a first end;

a plurality of planar blades;

wherein the blades are supported on the body so that the plane of each blade intersects the plane of at least one other of the blades and so that the planes of the blades transect the body; and at least one cutting element supported on the body near the first end of the body and adapted to make first contact with the walls of the bore and enlarge the bore as the device is moved through the bore;

wherein the plurality of blades comprises a first blade characterized by the ability to enlarge the bore and second and third blades characterized by the ability to churn spoils.

40. A device for making or enlarging a bore, the device comprising:

an elongate body connectable to a source for moving the device through the bore, the body having a first end and second end;

a plurality of planar blades;

wherein the plurality of blades comprises a first blade supported near the first end of the body and non-perpendicularly angled relative to the body so as to be characterized by the ability to enlarge the bore, a second blade and a third blade, the second and third blades both being non-perpendicularly angled relative to the body and supported on the body between the first blade and the second end of the body so that the second and third blades are characterized by the ability to churn spoils.

41. A method for enlarging a bore using a boring machine adapted to bore a pilot bore in the earth from a point of entry to an exit point distant from the boring machine, the method comprising the steps:

connecting an enlarging device to the distal end of the boring machine, the enlarging device comprising an elongate body connectable to a source for moving the device through the bore and a plurality of planar blades, wherein the plurality of blades are supported on the body so that the plane of each of the blades intersects the plane of at least one other of the blades; and moving the enlarging device through the bore in a manner to enlarge the bore, including first enlarging the bore to an intermediate diameter and then to a final diameter.

42. A method for installing utility lines and the like by using a boring machine adapted to bore a pilot bore in the earth from a point of entry to an exit point distant from the boring machine, the method comprising the steps of:

connecting an enlarging device to the distal end of the boring machine, the enlarging device comprising an elongate body connectable to a source for moving the device through the bore and a plurality of planar blades, wherein the blades are supported on the body so that the plane of each of the blades intersects the plane of at least one other of the blades;

moving the enlarging device through the bore in a manner to enlarge the bore including enlarging the bore first to an intermediate diameter and then to a final diameter; and simultaneously pulling in the utility line into the bore while moving the enlarging device through the bore.

43. A device for making or enlarging a bore, the device comprising:

an elongate body connectable to a source for moving the device through the bore and having a first and second end; and a plurality of planar, ovate blades supported on the body so that the plane of each of the blades intersects at least one of the other of the blades, and so that the plane of each blade transects the body;

wherein the plurality of blades includes a first, second and third blade; and wherein the second blade is positioned on the body between the first and third blades.

44. The device of claim 43 wherein the elongate body extends through each of the plurality of blades so that the blade completely surrounds the body.

45. The device of claim 44 wherein each of the ovate blades has opposing ends, and wherein the elongate body extends through each of the blades near one of the opposing ends.

* * * * *